US006299413B1

(12) United States Patent
Stahlman et al.

(10) Patent No.: US 6,299,413 B1
(45) Date of Patent: Oct. 9, 2001

(54) PUMP HAVING A BLEEDING VALVE

(75) Inventors: David Stahlman, Mooresville, NC (US); Raymond Carter, Bryan, OH (US)

(73) Assignee: Ingersoll-Rand Company, Woodcliff Lake, NJ (US)

( * ) Notice: Subject to any disclaimer, the term of this patent is extended or adjusted under 35 U.S.C. 154(b) by 0 days.

(21) Appl. No.: 09/593,717

(22) Filed: Jun. 14, 2000

(51) Int. Cl.[7] ..... F04B 19/24

(52) U.S. Cl. ..... 417/53; 417/440; 417/534; 92/182; 92/183

(58) Field of Search ..... 417/53, 440, 534; 92/182, 183

(56) References Cited

U.S. PATENT DOCUMENTS

| | | | | |
|---|---|---|---|---|
| Re. 34,301 | * | 7/1993 | Brooks | 91/224 |
| 3,698,182 | * | 10/1972 | Knoos | 60/24 |
| 3,768,932 | * | 10/1973 | Svercl et al. | 417/393 |
| 4,825,752 | * | 5/1989 | Kiffmeyer | 91/422 |
| 5,079,997 | * | 1/1992 | Hong | 92/23 |
| 5,832,727 | * | 11/1998 | Stanley | 60/372 |

OTHER PUBLICATIONS

Operator's Manual #6695X–X, entitled *Four–Ball Style Lower Pump End*, released Feb. 12, 1991, revised Nov. 22, 1996, issued by Ingersoll–Rand Fluid Products, pp 1–4.

* cited by examiner

*Primary Examiner*—Charles G. Freay
*Assistant Examiner*—E O Hayes
(74) *Attorney, Agent, or Firm*—Steven E. Koffs

(57) ABSTRACT

A pump comprises a housing having a fluid inlet and a fluid outlet. A piston is mounted for reciprocating motion in first and second directions within the housing. The housing has first and second cavities on first and second sides of the piston, respectively. The first and second cavities are fluidly coupled to the fluid inlet and fluid outlet, so that fluid is pumped to the fluid outlet when the piston moves in either of the first and second directions. A bleed valve is coupled between the first and second cavities. The bleed valve has first and second closed states and an open state. The bleed valve changes from the first closed state through the open state to the second closed state when the piston moves in the first direction. The bleed valve changes from the second closed state through the open state to the first closed state when the piston moves in the second direction.

13 Claims, 5 Drawing Sheets

PUMP HAVING A BLEEDING VALVE

DESCRIPTION OF THE RELATED ART

The present invention relates to the field of pumps, generally, and more specifically to pumps driven by a reciprocating piston.

FIELD OF THE INVENTION

Four-ball pumps have been used in spraying applications for many years, in such diverse applications as spraying furniture and automobiles. A typical four ball pump has a reciprocating piston, which may be pneumatically powered. Fluid is drawn up into the inlet and propelled from the outlet, both on the upstroke and downstroke of the piston. On the upstroke of the piston, fluid is drawn up beneath the piston, and fluid above the piston is propelled out of the fluid outlet. On the downstroke of the piston, fluid beneath the piston is forced into a first tube that is fluidly coupled to the fluid outlet, and a second tube coupled to the cavity above the piston. The fluid in the first tube is propelled out of the outlet. Meanwhile, a partial vacuum is formed on top of the piston, drawing the fluid from the second tube into the cavity above the top of the piston. This flow is regulated by four ball-type check valves.

The piston of a conventional four ball pump is connected to a pneumatic pressure source, even when no spray is required, and the fluid flow is cut off by closing the fluid outlet (for example, by closing a nozzle attached to the fluid outlet). When the fluid outlet is closed, fluid can no longer pass between the cavities above and below the piston, and the motion of the piston stops. This conserves pneumatically supplied power.

When the pump is first started up (also known as priming), air becomes trapped under the piston. Because the air rises above the liquid under the piston, the air cannot escape. Unlike liquids, air is compressible. When the pump transitions from the upstroke to the downstroke of the piston, the air beneath the piston is compressed, causing a pressure pulse. This change in the pressure at the fluid outlet causes an uneven finish in the article being sprayed.

In an attempt to eliminate the trapped air and reduce the pressure changes and uneven finish caused by the trapped air, others have located a small orifice in the piston, connecting the cavities above and below the piston. The trapped air below the piston can bleed through the hole, and escape through the cavity above the piston and the fluid outlet. Although this hole allows the trapped air to escape, it has not been a satisfactory solution. Because fluid can now pass between the cavities above and below the piston, the piston continues its reciprocating motion, even when the fluid outlet is closed. Thus, the pump continues to consume air power, even when not in use. Another problem is that particles forced through the small orifice can break down. For example, metallic particles in metallic paint break down, so that after several hours, the paint has a different appearance. Further, over time, the continuous flow through the orifice enlarges the hole, bypassing an increasing amount of fluid.

An improved pump is desired.

SUMMARY OF THE INVENTION

A pump comprises a housing having a fluid inlet and a fluid outlet. A piston is mounted for reciprocating motion in first and second directions within the housing. The housing has first and second cavities on first and second sides of the piston, respectively. The first and second cavities are fluidly coupled to the fluid inlet and fluid outlet, so that fluid is pumped to the fluid outlet when the piston moves in either of the first and second directions.

A bleed valve is coupled between the first and second cavities. The bleed valve has first and second closed states and an open state. The bleed valve changes from the first closed state through the open state to the second closed state when the piston moves in the first direction. The bleed valve changes from the second closed state through the open state to the first closed state when the piston moves in the second direction.

DETAILED DESCRIPTION

Figure 1:
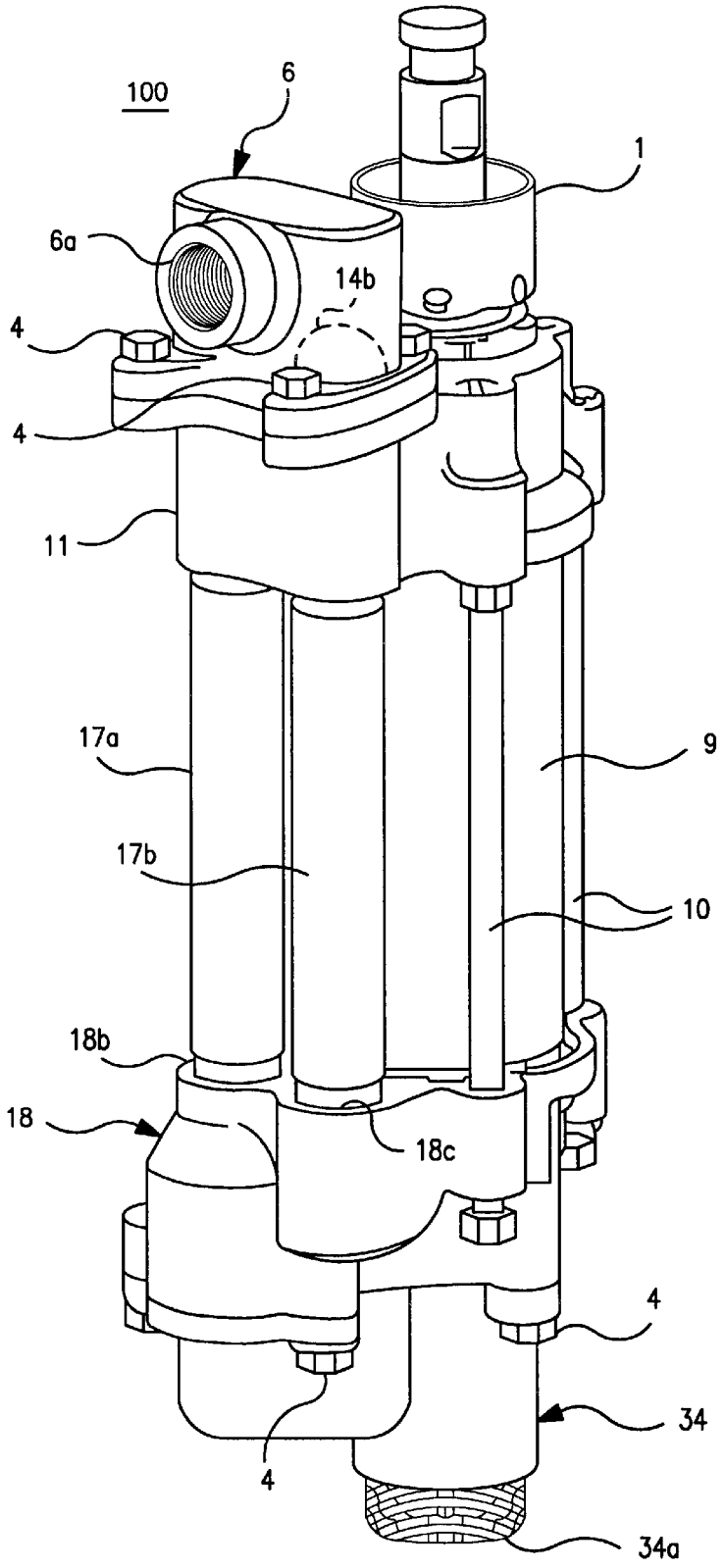
FIG. 1 is an isometric view of an exemplary pump according to the present invention.
Figure 2:
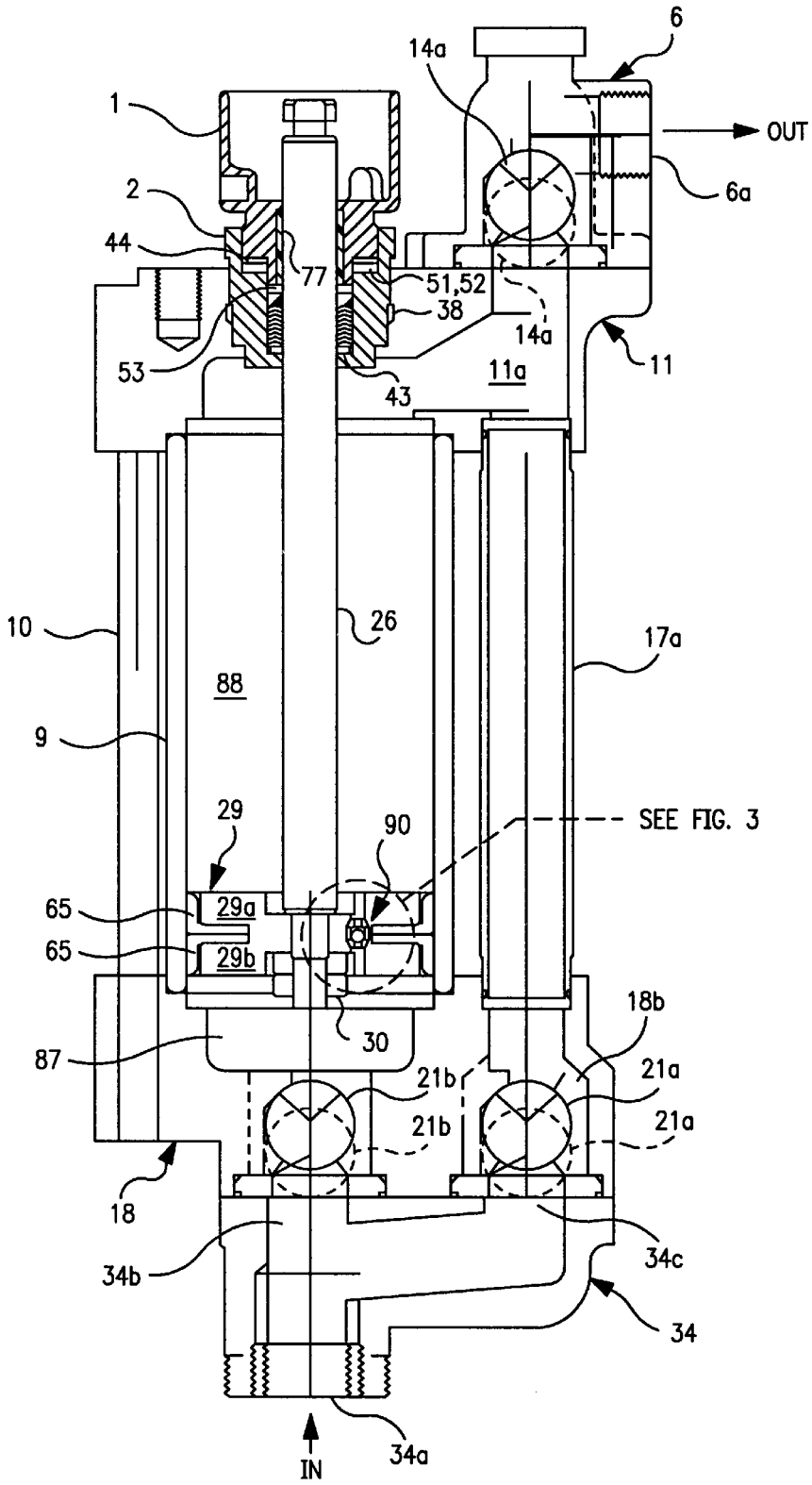
FIG. 2 is a cross sectional view of the pump of FIG. 1.
Figure 3:
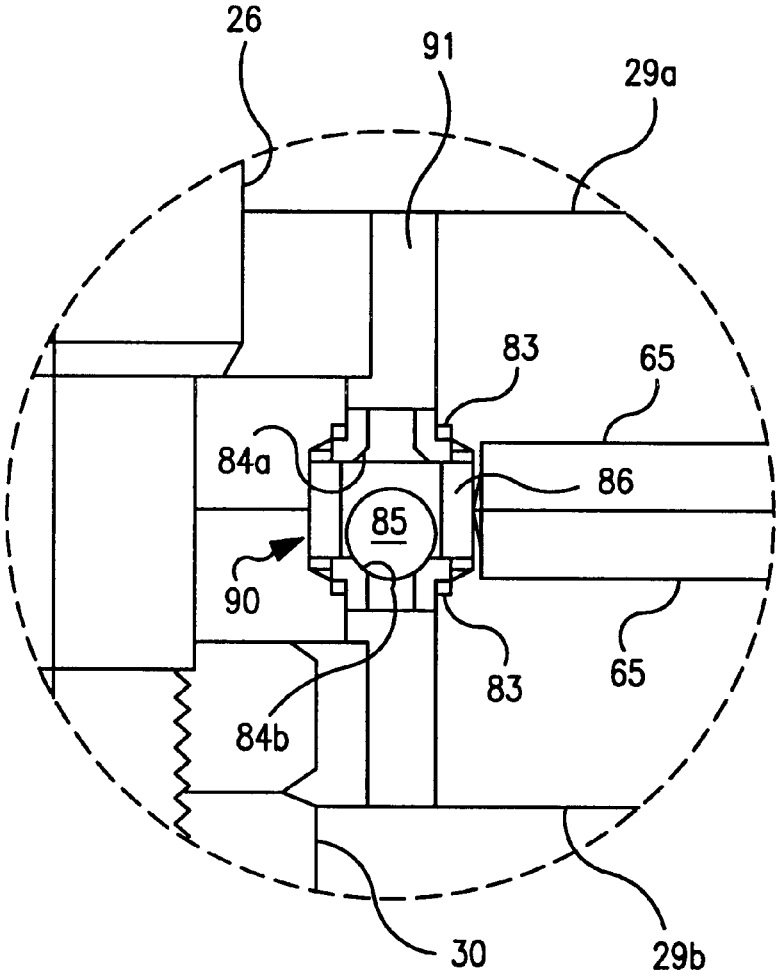
FIG. 3 is an enlarged view of a feature shown in FIG. 2.
Figure 4:
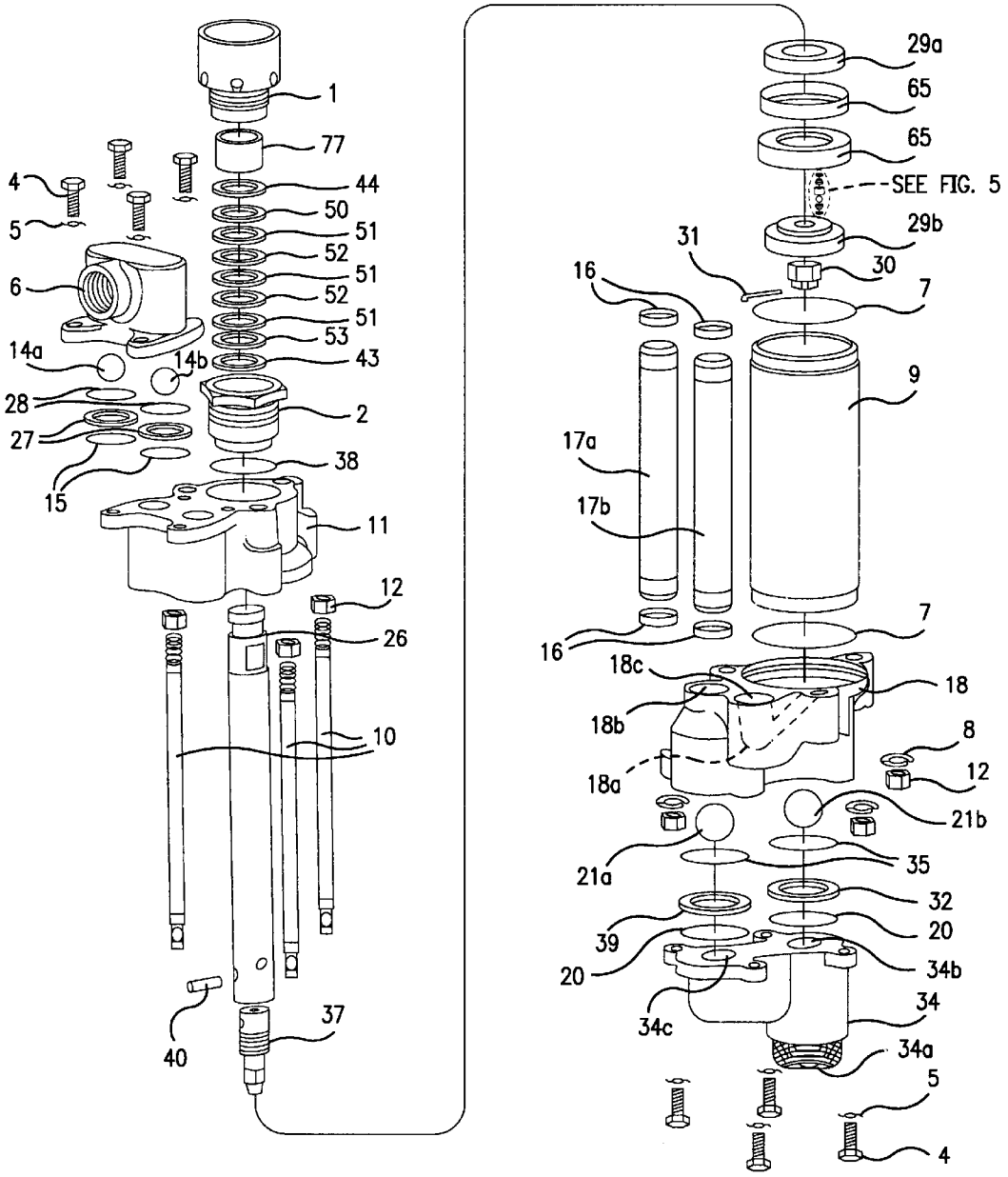
FIG. 4 is an exploded view of the pump shown in FIG. 1.
Figure 5:
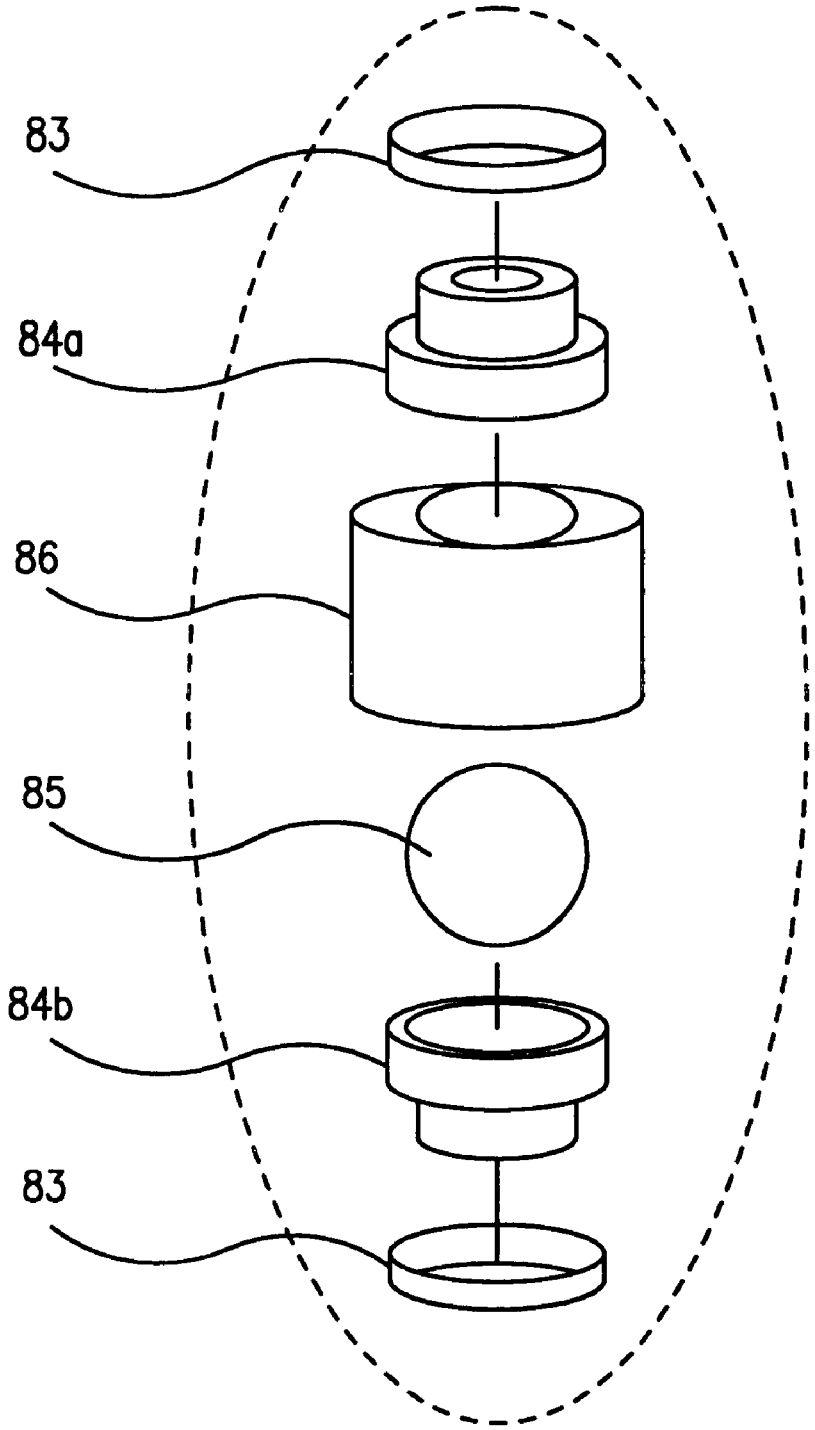
FIG. 5 is an enlarged view of a feature shown in FIG. 4.

FIGS. 1–5 show an exemplary pump 100 according to the present invention. FIGS. 1, 2 and 4 show general features of the pump 100. FIGS. 3 and 5 are enlarged views of a bleed valve 90 that is described in detail below.

The pump 100 has a housing. In the exemplary embodiment, the housing includes an upper body 11, a lower body 18, and an inlet body 34, which may all be made of stainless steel or other suitably strong and corrosion resistant material. The upper body 11 and lower body 18 are connected to each other by three tie rods 10 and tie rod nuts 12, which may be made of stainless steel, for example. The inlet body 34 is mounted to the lower body 18, for example by bolts 4. The upper body 11 and lower body 18 are also connected to each other by a piston tube 9 and two downtubes 17*a* and 17*b*, which conduct fluid between the fluid inlet 34*a* and upper body 11. The downtubes 17*a* and 17*b* may be made of stainless steel, for example, and the piston tube 9 may be made of ceramic coated stainless steel or hard chrome plated stainless steel, for example.

The upper body 11 of the housing has a ball cap 6 with a fluid outlet 6*a* attached thereto. The inlet body 34 of the housing has a fluid inlet 34*a*. The inlet body 34 has two outlet holes, 34*b* and 34*c*. The lower body 18 has two main passages 18*a* and 18*b* through it. One passage 18*a* (shown in phantom in FIG. 4) connects the cavity 87 beneath the piston tube 9 to a mounting hole 18*c*, to which downtube 17*b* is mounted. A passage 18*b* connects the outlet hole 34*c* of inlet body 34 to downtube 17*a*. Fluid from the inlet 34*a* can either flow through passage 34*b* beneath piston tube 9 or through passage 34*c* and passage 18*b* to downtube 17*a*, under control of check valves, as shown in FIG. 2 and described below. Fluid in cavity 87 beneath the piston tube 9 can flow through passage 18*a* to downtube 17*b*.

A piston 29 is mounted for reciprocating motion in first and second directions (e.g., up and down) within the piston tube 9 of the housing. The exemplary piston 29 includes a pair of cylindrical followers 29*a* and 29*b* attached to the lower end of a pump rod 26 and movable within the tube 9. The followers may be made of stainless steel or the like. The pump rod 26 may be made from hard stainless steel, either ceramic coated or hard chrome plated. The followers 29*a*, 29*b* have a pair of cup packings 26, to prevent leakage between the first cavity 87 below the piston 29 and the second cavity 88 above the piston. The cup packings 26 may be made from ultra high molecular weight polyethylene (UHMWPE), for example. The first cavity 87 and the second cavity 88 are fluidly coupled to the fluid inlet 34*a* and fluid outlet 6*a*, respectively, as described below, so that fluid is pumped to the fluid outlet when the piston 29 moves in either of the first (upward in FIG. 2) and second (downward in FIG. 2) directions.

The piston 29 is slidably supported at the top end by bushing 77 held in place between a solvent cup 1 and a gland nut 2. The bushing 77 may be made of acetal or polyphenylene sulfide, or the like. Gland nut 2 may be made of stainless steel. A seal is provided between the solvent cup 1 and gland nut 2 by washers 44 and 50 and packing 51 and 52. The washers 44 and 50 may be made from stainless steel, acetal, or polyphenylene sulfide, for example. The packing 51 and 52 may be, for example, glass filled Teflon, UHMWPE, leather, or the like. Within the gland nut 2, a wave spring 43 and washer 53 bias the bushing 77, to maintain its position during motion of the pump rod 26. The spring 43 and washer 53 may be made from stainless steel, for example.

Fluid flow within the pump 100 is primarily controlled by four check valves. In the exemplary embodiment, the four check valves are ball valves 14*a*, 14*b*, 21*a* and 21*b*, but other types of check valves may be used. The ball valves 14*a*, 14*b*, 21*a* and 21*b* each include a stainless steel ball with a hardened stainless steel seat 27, 32.

The first check valve 21*b* is positioned between the fluid inlet 34*a* and the first cavity 87 beneath the piston 29. During the upstroke of piston 29, check valve 21*b* is open, permitting fluid to be drawn through passage 34*b* into the cavity 87, by the partial vacuum in the cavity 87. During the downstroke of the piston 29, valve 21*b* is checked (as shown in phantom in FIG. 2), preventing the fluid in cavity 87 from entering the fluid inlet 34*a*. During the downstroke, the fluid in cavity 87 flows through the passage 18*a* in lower body 18 directly to the downtube 17*b*.

The second check valve 21*a* fluidly connects the fluid inlet 34*a* and a downtube 17*a*. Downtube 17*a* is fluidly coupled by a passage 11*a* (FIG. 2) within the upper body 11 to the second cavity 88 above the piston 29. During the downstroke, fluid enters inlet 34*a* and passes though passage 34*c*, second check valve 21*a*, downtube 17*a* and passage 11*a* into cavity 88. During the upstroke of the piston 29, pressure in the second cavity 88 forces the second check valve 21*a* to the checked position (shown in phantom in FIG. 2), so that fluid from the fluid inlet 34*a* cannot enter downtube 17*a*.

The third check valve 14*a* (FIGS. 2 and 4) is fluidly coupled to the fluid outlet 6*a*, for transmitting fluid from the second cavity 88 through the fluid outlet when the piston 29 moves in the first (upward) direction. During the upstroke of piston 29, the third check valve 14*a* is in the open position shown by solid lines in FIG. 2; fluid flows from cavity 88 through 25 passage 11*a*, through valve 14*a*, and out through outlet 6*a*. During the downstroke of piston 29, the third check valve 14*a* is in the checked position shown in phantom in FIG. 2 (because of the partial vacuum in the second cavity 88), thus preventing backflow of any fluid from the fluid outlet into the valve 100, and isolating downtube 17*a* from the fluid outlet.

The fourth check valve 14*b* is fluidly coupled to the fluid outlet 6*a*, for transmitting fluid from the first cavity 87 to the fluid outlet by way of downtube 17*b*, when the piston 29 moves in the second (downward) direction. Downtube 17*b* is fluidly connected to the first cavity 87 by way of passage 18*a*, without an intervening check valve. During the downstroke, fluid from the first cavity 87 flows directly through the passage 18*a* in lower body 18 to downtube 17*b*, up through the downtube 17*b*, through check valve 14*b* to the fluid outlet 6*a*. During the upstroke of the piston 29, the fourth check valve 14*b* is checked (due to the partial vacuum in cavity 87), preventing backflow of any fluid from the fluid outlet 6*a* into the valve 100, and isolating downtube 17*b* (and the first cavity 87) from the fluid outlet.

In summary, during the downstroke, the first check valve 21*b* is checked, the second check valve 21*a* is open, the third check valve 14*a* is checked, and the fourth check valve 14*b* is open. During the downstroke, fluid from the inlet 34*a* passes through passage 34*c*, valve 21*a*, downtube 17*a*, passage 11*a* into second cavity 88, and fluid from cavity 87 passes through passage 18*a*, downtube 17*b*, valve 14*b*, and the outlet 6*a*. During the upstroke, the first check valve 21*b* is open, the second check valve 21*a* is checked, the third check valve 14*a* is open, and the fourth check valve 14*b* is checked. During the upstroke, fluid from the inlet 34*a* passes through passage 34*b* and valve 21*b* into cavity 87, and fluid from cavity 88 passes through passage 11*a*, valve 14*a* and out of outlet 6*a*.

Additional conventional elements shown in FIG. 4 are not described in detail herein, including 0-rings 7, 15, 20, 28, 35, and 38; ball valve seats 27, 32, and 39; seals 16; washers 5, 8, 44, 50, 53; nuts 12 and 30; cotter pin 31; and roll pin 40. The functions of these elements for joining the major components are understood by those of ordinary skill in the art.

According to an aspect of the invention, a bleed valve 90 (best seen in FIGS. 3 and 5) is coupled between the first cavity 87 and the second cavity 88. The bleed valve 90 has first and second closed states and an open state. The exemplary bleed valve 90 has a bleed passage 91 penetrating the piston 29. The bleed passage 91 has a first valve seat 84*a* and a second valve seat 84*b* with a ball 85 in between the seats. The ball 85 and seats 84*a*, 84*b* may be made from, for example, tungsten carbide. The ball 85 seats in the first valve seat 84*a* when the piston 29 moves in the first (downward) direction and seats in the second valve seat 84*b* when the piston 29 moves in the second (upward) direction. Bleed valve 90 also includes a spacer 86 (which may be made from stainless steel) separating the seats 84*a* and 84*b* and a pair of gaskets 83, which may be nylon, for sealing the bleed valve.

When the ball 85 is seated in valve seat 84*b*, valve 90 is in the first closed state. When the ball 85 is seated in valve seat 84*a*, valve 90 is in the second closed state. When the ball is not seated in either seat 84*a* or seat 84*b*, the valve 90 is in the open state. While the bleed valve 90 is in the open state, air can escape from the first cavity 87 beneath the piston 29. The bleed valve 90 changes from the first closed state (in seat 84*b*) through the open state to the second closed state (in seat 84*a*) when the piston 29 moves in the first direction (downward). The bleed valve 90 changes from the second closed state (in seat 84*a*) through the open state to the first closed state (in seat 84*b*) when the piston 29 moves in the second direction (upward).

As a result, the bleed valve 90 enters the open state for a brief period shortly after a change in direction of the piston 29. More specifically, when the piston 29 changes from the upstroke to the downstroke, the ball 85 moves from seat 84*b* to seat 84*a*, allowing a small quantity of air to bleed out of cavity 87 while the ball 85 is in between the seats. After the piston 29 has progressed through about ten strokes, most or all of the air is bled out of the cavity 87. By eliminating the air from cavity 87, pressure pulses are eliminated. Thus, the exemplary pump 100 ensures even spraying and an even finish on any workpiece. Similarly, if the fluid source (e.g., a bucket of paint, not shown) that provides fluid to the fluid inlet 34*a* is changed, any air that enters cavity 87 is bled out within about ten strokes of the piston 29.

An additional advantage of the bleed valve 90 is that the pump 100 automatically shuts off when the fluid outlet 6*a* is closed. For example, a spray nozzle (not shown) may be attached to the fluid outlet 6*a*. When the nozzle is closed, the fluid outlet 6*a* prevents egress of fluid through either the third ball valve 14*a* or the fourth ball valve 14*b*, which both become checked, thus preventing egress of fluid through downtube 17*a* or 17*b*.

For example, if the piston 29 is entering its upstroke, as shown in FIG. 2, then the bleed valve ball 85 is seated in seat 84*b* as shown in FIG. 3. Thus, no fluid can pass directly between the first cavity 87 and the second cavity 88. Because fluid is incompressible, the piston 29 is effectively prevented from moving upward, because the closed nozzle (not shown) checks valve 14*a* and prevents fluid from leaving the fluid outlet 6*a*. The pressure in the second cavity 88 also causes the second valve 21*a* to become checked, preventing fluid from leaving via the fluid inlet.

Similarly, if the nozzle is closed while the piston 29 is beginning its downstroke, the ball 85 of the bleed valve 90 is seated in the upper seat 84*a*, preventing fluid flow between the first cavity 87 and the second cavity 88. The incompressible fluid in the first cavity 87 closes the first check valve 21*b*, preventing egress of fluid through the inlet 34*a*. The nozzle prevents fluid flow through the fourth check valve 14*b*, the downtube 17*b*, or passage 18*a*. Thus, the incompressible fluid in the first cavity cannot escape, and the motion of the piston 29 stops.

Because the piston 29 can neither move up or down, the pump 100 essentially shuts down. Because the piston 29 is driven by an air source (not shown), when the piston stops moving, the pump stops consuming air, but is still pressurized.

Other embodiments of the invention are contemplated. For example, in one variation of the pump (not shown), the upper and lower body may be joined by fewer or more than three tie rods. In another variation of the pump (not shown), the housing may be formed as a solid casting or molded body in left and right halves (the piston tube 9 and downtubes 17*a* and 17*b* may be integrally formed as part of the housing or may be separate tubes fitting inside the housing). In some embodiments of the invention, the housing of the pump may be divided into fewer or more sections than are shown in FIG. 4. Further, although exemplary materials are described above, one of ordinary skill in the art may substitute equivalent materials without changing the function of the pump described above.

Although the invention has been described in terms of exemplary embodiments, it is not limited thereto. Rather, the appended claim should be construed broadly, to include other variants and embodiments of the invention which may be made by those skilled in the art without departing from the scope and range of equivalents of the invention.

What is claimed is:

1. A pump, comprising:

a housing having a fluid inlet and a fluid outlet;

a piston mounted for reciprocating motion in first and second directions within the housing, the housing having first and second cavities on first and second sides of the piston, respectively, the first and second cavities being fluidly coupled to the fluid inlet and fluid outlet so that fluid is pumped to the fluid outlet when the piston moves in either of the first and second directions;

a bleed valve coupled between the first and second cavities and having first and second closed states and an open state, the bleed valve changing from the first closed state through the open state to the second closed state when the piston moves in the first direction, the bleed valve changing from the second closed state through the open state to the first closed state when the piston moves in the second direction.

2. The pump of claim 1, wherein the bleed valve includes:

a bleed passage penetrating the piston, the bleed passage having first and second valve seats, and a ball that seats in the first valve seat when the piston moves in the first direction and seats in the second valve seat when the piston moves in the second direction.

3. The pump of claim 2, wherein the bleed valve is in the open state, permitting air to escape from the first cavity, while the ball is between the first valve seat and the second valve seat.

4. The pump of claim 1, wherein the first cavity is beneath the piston, and the second cavity is above the piston.

5. The pump of claim 1, further comprising:

a first check valve fluidly coupled to the fluid inlet, for admitting fluid into the first cavity when the piston moves in the first direction;

a second check valve fluidly coupled to the fluid inlet, for admitting fluid into the second cavity when the piston moves in the second direction;

a third check valve fluidly coupled to the fluid outlet, for transmitting fluid from the second cavity through the fluid outlet when the piston moves in the first direction; and a fourth check valve fluidly coupled to the fluid outlet, for transmitting fluid from the first cavity through the fluid outlet when the piston moves in the second direction.

6. The pump of claim 5, wherein the first, second, third and fourth check valves are ball valves.

7. A pump, comprising:

a housing having a fluid inlet and a fluid outlet;

a piston mounted for reciprocal motion within the housing, the housing having first and second cavities on first and second sides thereof, respectively;

a first check valve fluidly coupled to the fluid inlet, for admitting fluid into the first cavity when the piston moves in a first direction;

a second check valve fluidly coupled to the fluid inlet, for admitting fluid into the second cavity when the piston moves in a second direction;

a third check valve fluidly coupled to the fluid outlet, for transmitting fluid from the second cavity through the fluid outlet when the piston moves in the first direction;

a fourth check valve fluidly coupled to the fluid outlet, for transmitting fluid from the first cavity through the fluid outlet when the piston moves in the second direction; and a bleed valve coupled between the first and second cavities and having first and second closed states and an open state, the bleed valve changing from the first closed state through the open state to the second closed state when the piston moves in the first direction, the bleed valve changing from the second closed state through the open state to the first closed state when the piston moves in the second direction.

8. A method of operating a pump having a housing, a fluid inlet, a fluid outlet, and a piston mounted for reciprocating motion in first and second directions within the housing, the housing having first and second cavities on first and second sides of the piston, respectively, the first and second cavities being fluidly coupled to the fluid inlet and fluid outlet, comprising the steps of:

pumping fluid to the fluid outlet when the piston moves in either of the first and second directions;

bleeding fluid through a bleed valve coupled between the first and second cavities while the bleed valve is in an open state, the bleed valve having first and second closed states;

changing the bleed valve from the first closed state through the open state to the second closed state when the piston moves in the first direction; and changing the bleed valve from the second closed state through the open state to the first closed state when the piston moves in the second direction.

9. The method of claim 8, wherein the bleed valve includes:

a bleed passage penetrating the piston, the bleed passage having first and second valve seats, and a ball that seats in the first valve seat when the piston moves in the first direction and seats in the second valve seat when the piston moves in the second direction.

10. The method of claim 9, wherein the bleed valve is in the open state, permitting air to escape from the first cavity, while the ball is between the first valve seat and the second valve seat.

11. The method of claim 8, wherein the first cavity is beneath the piston, and the second cavity is above the piston.

12. The method of claim 8, further comprising:

admitting fluid into the first cavity via a first check valve fluidly coupled to the fluid inlet, when the piston moves in the first direction;

admitting fluid into the second cavity via a second check valve fluidly coupled to the fluid inlet, when the piston moves in the second direction;

transmitting fluid from the second cavity through the fluid outlet via a third check valve fluidly coupled to the fluid outlet, when the piston moves in the first direction; and transmitting fluid from the first cavity through the fluid outlet via a fourth check valve fluidly coupled to the fluid outlet, when the piston moves in the second direction.

13. The method of claim 12, wherein the first, second, third and fourth check valves are ball valves.

* * * * *